US007980659B2

(12) United States Patent
Sekiyama

(10) Patent No.: US 7,980,659 B2
(45) Date of Patent: Jul. 19, 2011

(54) LIQUID DROPLET EJECTING APPARATUS

(75) Inventor: Takaaki Sekiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 12/205,316

(22) Filed: Sep. 5, 2008

(65) Prior Publication Data

US 2009/0189945 A1 Jul. 30, 2009

(30) Foreign Application Priority Data

Jan. 28, 2008 (JP) ..... 2008-016858

(51) Int. Cl.
*B41J 2/165* (2006.01)

(52) U.S. Cl. ..... 347/33; 347/20; 347/32

(58) Field of Classification Search ..... 347/33, 347/29, 32, 20–22, 38, 40, 46–47, 67
See application file for complete search history.

(56) References Cited

U.S. PATENT DOCUMENTS

| | | | | |
|---|---|---|---|---|
| 5,500,660 | A * | 3/1996 | Childers et al. | 347/33 |
| 5,557,306 | A | 9/1996 | Fukushima et al. | |
| 6,540,324 | B2 * | 4/2003 | Medin | 347/33 |
| 6,764,160 | B1 * | 7/2004 | Phillips et al. | 347/32 |
| 2006/0176334 | A1 | 8/2006 | Ishiyama et al. | |
| 2010/0149253 | A1 * | 6/2010 | Kusunoki | 347/33 |

FOREIGN PATENT DOCUMENTS

| | | |
|---|---|---|
| JP | 07-032600 | 2/1995 |
| JP | 7-032600 | 2/1995 |
| JP | 07-047679 | 2/1995 |
| JP | 3535885 | 4/1995 |
| JP | 11-342601 | 12/1999 |
| JP | 2004-167928 | 6/2004 |
| JP | 2005-125689 | 5/2005 |
| JP | 2006-218747 | 8/2006 |
| JP | 2006-247999 | 9/2006 |

* cited by examiner

*Primary Examiner* — Thinh H Nguyen
(74) *Attorney, Agent, or Firm* — Fildes & Outland, P.C.

(57) ABSTRACT

A liquid droplet ejecting apparatus includes a liquid droplet ejecting head that includes nozzles that eject liquid droplets in accordance with image information, a nozzle surface thereof being inclined so as to correspond to a peripheral surface of a rotating member; and a wiping member that wipes and cleans the nozzle surface that has been moistened by liquid that has been exuded from the nozzles of the liquid droplet ejecting head, and whose wiping direction is a direction from a downstream side to an upstream side of a direction in which the liquid that has been exuded from the nozzles flows along the nozzle surface due to the force of gravity.

8 Claims, 16 Drawing Sheets

UP 20
21
24
66
68
70
72
40
N
W1

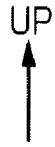
FIG. 8A
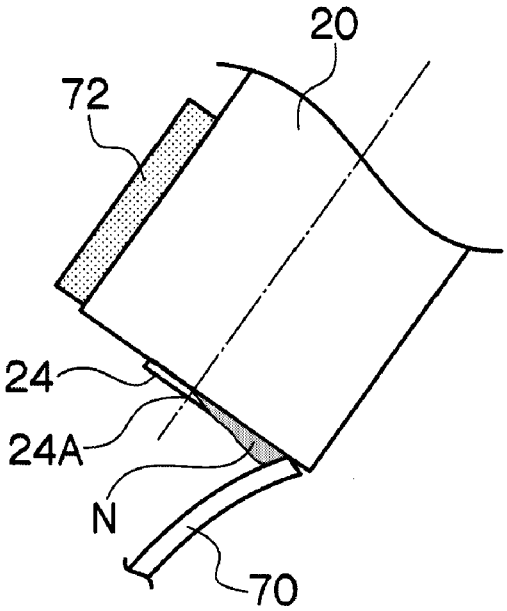
FIG. 8B
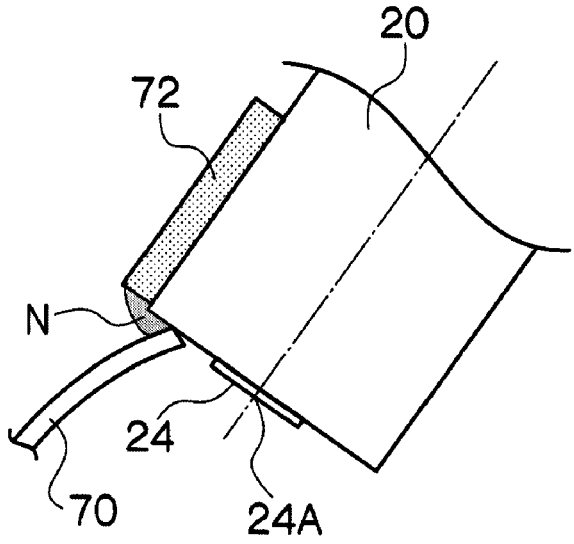

UP 20
21
24
40
66
68
70
72
N
W1

UP
20
21
24
66
68
70
72
40
W1
θ
N

LIQUID DROPLET EJECTING APPARATUS

CROSS-REFERENCE TO RELATED APPLICATION

This application is based on and claims priority under 35 USC 119 from Japanese Patent Application No. 2008-016858 filed Jan. 28, 2008.

BACKGROUND

1. Technical Field

The present invention relates to a liquid droplet ejecting apparatus.

2. Related Art

Liquid droplet ejecting apparatus where a recording medium is held on the peripheral surface of a rotating member and where liquid droplet ejecting heads of respective colors are disposed such that they are inclined so as to correspond to the peripheral surface of the rotating member are conventionally known. Further, liquid droplet ejecting apparatus where, after liquid is exuded from the nozzles and the nozzle surface is moistened, a wiping member moves in the longitudinal direction of the nozzle surface (i.e., in the width direction of a recording medium) and wipes and cleans the nozzle surface are conventionally known.

SUMMARY

An aspect of the present invention is a liquid droplet ejecting apparatus including: a liquid droplet ejecting head that includes nozzles that eject liquid droplets in accordance with image information, a nozzle surface thereof being inclined so as to correspond to a peripheral surface of a rotating member; and a wiping member that wipes and cleans the nozzle surface that has been moistened (wet) by liquid that has been exuded from the nozzles of the liquid droplet ejecting head, and whose wiping direction is a direction from a downstream side to an upstream side of a direction in which the liquid that has been exuded from the nozzles flows along the nozzle surface due to the force of gravity.

BRIEF DESCRIPTION OF THE DRAWINGS

Exemplary embodiments of the present invention will be described in detail based on the following figures, wherein:

FIG. 8A and FIG. 8B are schematic side views showing wiping action by the wiper blade;

DETAILED DESCRIPTION

Figure 1:
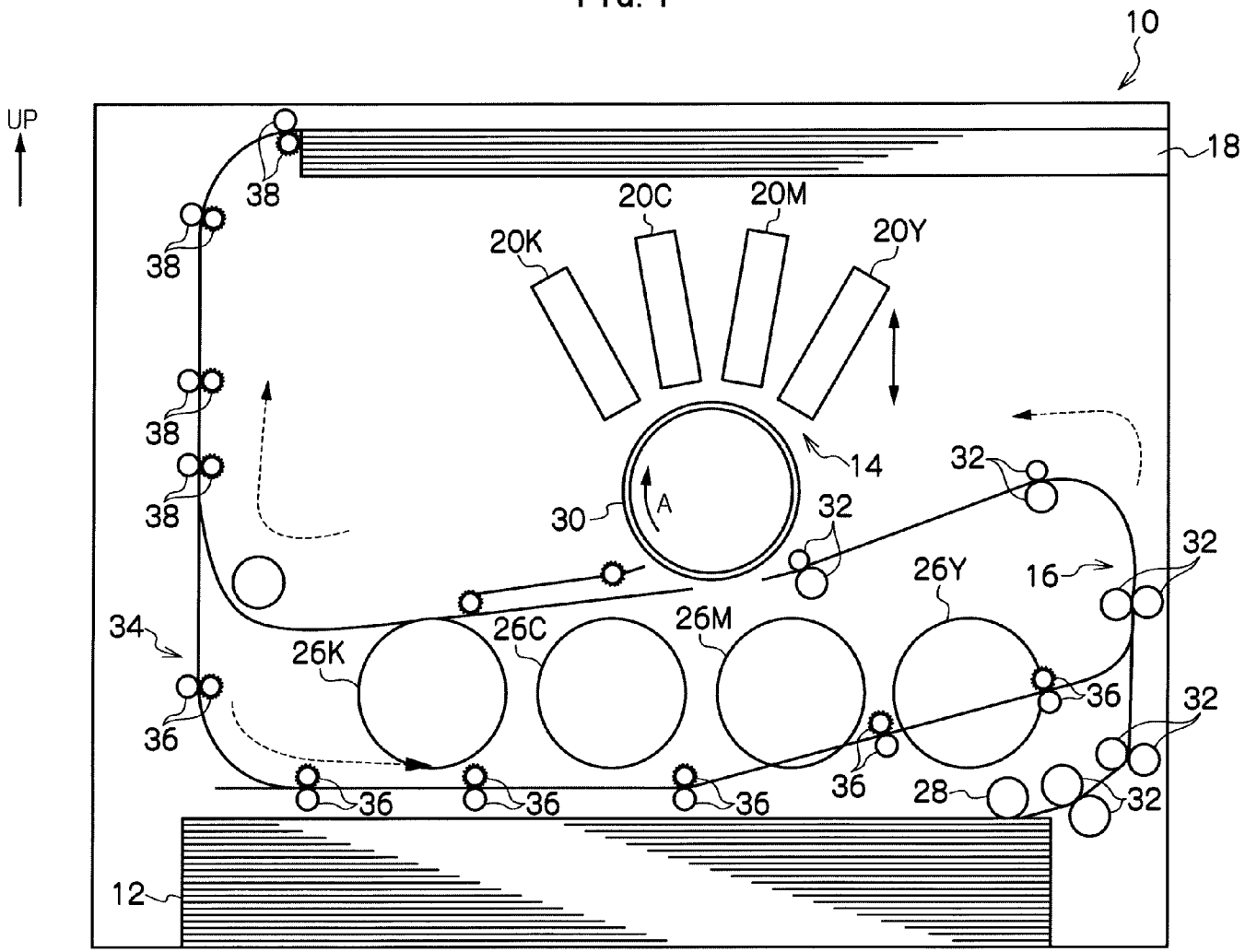
FIG. 1 is a schematic side view showing the configuration of an inkjet recording apparatus during printing.
Figure 2:
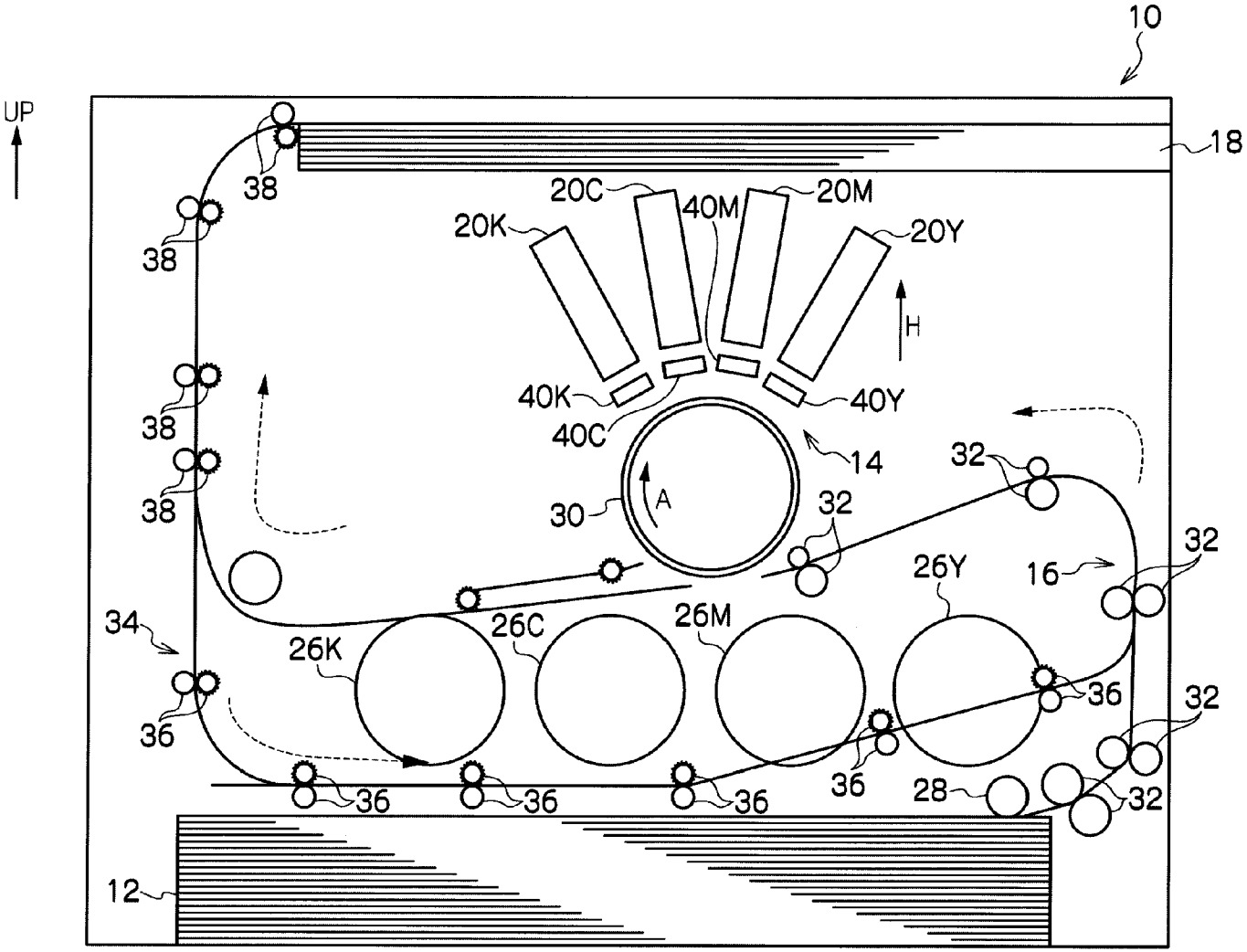
FIG. 2 is a schematic side view showing the configuration of the inkjet recording apparatus during maintenance.

Below, an exemplary embodiment of the present invention will be described in detail on the basis of examples shown in the drawings. In FIG. 1 and FIG. 2, there is shown the general configuration of an inkjet recording apparatus 10 that serves as an example of a liquid droplet ejecting apparatus. Below, inkjet recording heads 20 will serve as liquid droplet ejecting heads, and recording paper P will serve as a recording medium on which an image is recorded by the liquid droplet ejecting heads.

Further, in each of the drawings, the direction indicated by arrow UP will represent an up direction. Moreover, surfaces of the inkjet recording heads 20 that face in the conveyance direction of the recording paper P during image formation by the inkjet recording heads 20 or the opposite direction of the conveyance direction will be called "front surfaces" of the inkjet recording heads 20 (that is, front-rear direction surfaces of the heads 20), and surfaces of the inkjet recording heads 20 that face in the width direction of the recording paper P, which is a direction that is perpendicular to the front surfaces, will be called "side surfaces" of the inkjet recording heads 20. Consequently, in FIG. 1 and FIG. 2, the side surfaces of the inkjet recording heads 20 are shown.

As shown in FIG. 1 and FIG. 2, the inkjet recording apparatus 10 includes a paper supply section 12 in which the recording paper P before an image is recorded thereon is housed, an image recording section 14 that records an image on the recording paper P that has been supplied from the paper supply section 12, conveyer 16 that conveys the recording paper P to the image recording section 14, and a paper discharge section 18 that houses the recording paper P after an image has been recorded thereon by the image recording section 14.

The image recording section 14 includes the inkjet recording heads 20, and the inkjet recording heads 20 include nozzle surfaces 24 (see FIG. 6) in which plural nozzles 22 are formed in one row (one-dimensionally arrayed). The nozzle surfaces 24 has a recordable region that is substantially the same as or greater than the maximum width of the recording paper P for which image recording by the inkjet recording apparatus 10 is assumed.

The inkjet recording heads 20 are, as described later, disposed such that their nozzle surfaces 24 are inclined so as to correspond to a peripheral surface of a conveyance drum 30 that serves as a rotating member that conveys the recording paper P, and the inkjet recording heads 20 are disposed adjacent to each other in the order of yellow (Y), magenta (M), cyan (C) and black (K) from the downstream side in the conveyance direction of the recording paper P (in the direction of arrow A).

The inkjet recording heads 20 are configured such that ink is ejected by known means such as a thermal system or a piezoelectric system. As the ink, various types of ink, such as water-based ink, oil-based ink or solvent-based ink, can be used. Further, ink tanks 26Y to 26K for supplying the ink to the inkjet recording heads 20Y to 20K are disposed in the inkjet recording apparatus 10.

In this manner, the inkjet recording heads 20 pertaining to the present exemplary embodiment are concentrically arrayed along the peripheral surface of the conveyance drum 30 and are disposed such that their nozzle surfaces 24 are inclined so as to correspond to the peripheral surface of the drum 30. For that reason, as described later, when ink N is exuded from the nozzles 22, the ink N flows downward due to the force of gravity. Consequently, below, the direction in which the ink N flows from a center position 24A of the nozzle surface 24 in the conveyance direction of the recording paper P will be called downstream side of the nozzle surface 24, and the opposite side will be called upstream side of the nozzle surface 24 (see FIG. 5 and FIG. 6).

As shown in FIG. 1 and FIG. 2, the recording paper P in the paper supply section 12 is taken out one sheet at a time by a pickup roller 28 and is sent to the image recording section 14 by conveyance roller pairs 32. The conveyer 16 that are disposed in the inkjet recording apparatus 10 are disposed with the conveyance drum 30 that serves as a rotating member that causes a printing surface (the front side) of the recording paper P to face the inkjet recording heads 20.

The conveyance drum 30 is configured to rotate at predetermined velocity in the direction of arrow A shown in FIG. 1 and FIG. 2 (a clockwise direction in the drawings), and a gripper (not shown) that serves as gripping means and grips the conveyance direction downstream side end portion of the recording paper P is disposed in a predetermined position on the peripheral surface of the conveyance drum 30. Additionally, the peripheral surface of the conveyance drum 30 is configured such that the recording paper P is held thereon by electrostatic attraction or non-electrostatic attraction such as suction or adhesion.

An inversion section 34 is disposed below the conveyance drum 30. During two-sided printing, the recording paper P is conveyed by plural conveyance roller pairs 36 and is again supplied toward the inkjet recording heads 20. Additionally, plural conveyance roller pairs 38 are also disposed in predetermined positions in the conveyance path leading to the paper discharge section 18.

Although they are not shown, the inkjet recording apparatus 10 includes a controller of the inkjet recording head 20 that determine the ejection timing of ink droplets and the nozzles 22 to be used in accordance with image signals and apply drive signals to those nozzles 22, and a system controller that control operation of the entire inkjet recording apparatus 10.

Figure 3:
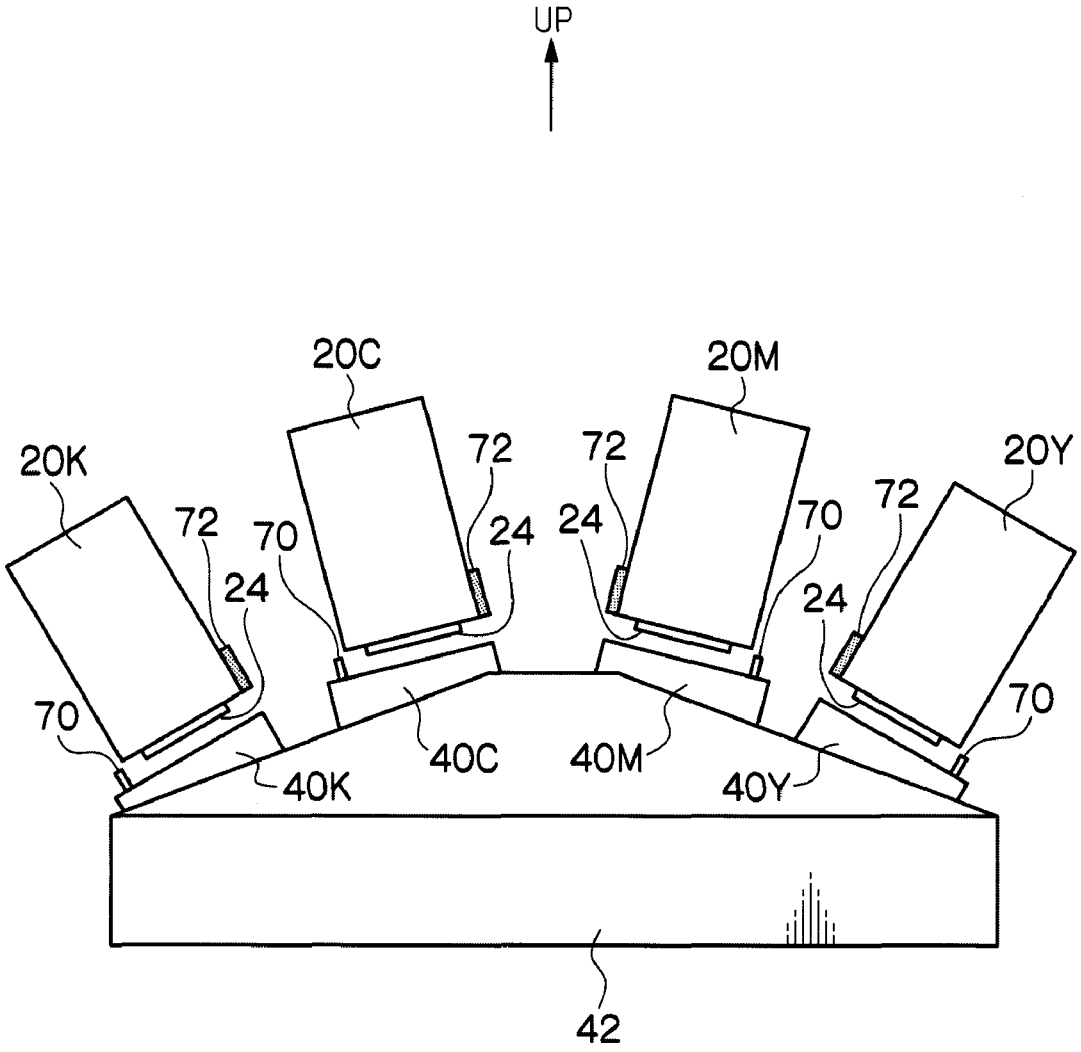
FIG. 3 is a schematic side view showing the configuration of inkjet recording heads during maintenance.

As shown in FIG. 3, maintenance units 40Y to 40K that serve as recovery devices are disposed for each color of the inkjet recording heads 20Y to 20K. The maintenance units 40Y to 40K are disposed in a maintenance unit holder 42. The maintenance unit holder 42 is configured to be movable (in the width direction of the recording paper P) by a moving unit (not shown) such as a rack-and-pinion between a standby position during printing and an execution position (see FIG. 2) where the maintenance units 40Y to 40K perform maintenance with respect to the inkjet recording heads 20Y to 20K.

The inkjet recording heads 20Y to 20K are configured such that, when maintenance is performed by the maintenance units 40Y to 40K with respect to the inkjet recording heads 20Y to 20K, the inkjet recording heads 20Y to 20K can rise a predetermined height to cause later-described caps 44 to face the nozzle surfaces 24 of the inkjet recording heads 20Y to 20K respectively. In other words, the inkjet recording heads 20Y to 20K are configured to be movable in a substantially vertical direction such that recovery operation and the like by the maintenance units 40Y to 40K can be performed.

Figure 4A:
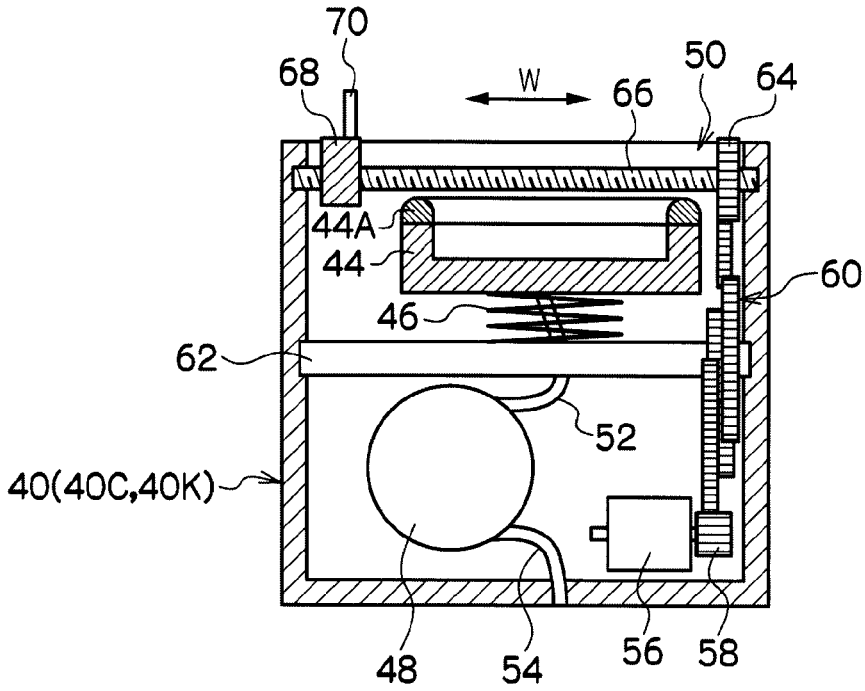
FIG. 4A and FIG. 4B are schematic side views showing the configuration of a maintenance unit.
Figure 4B:
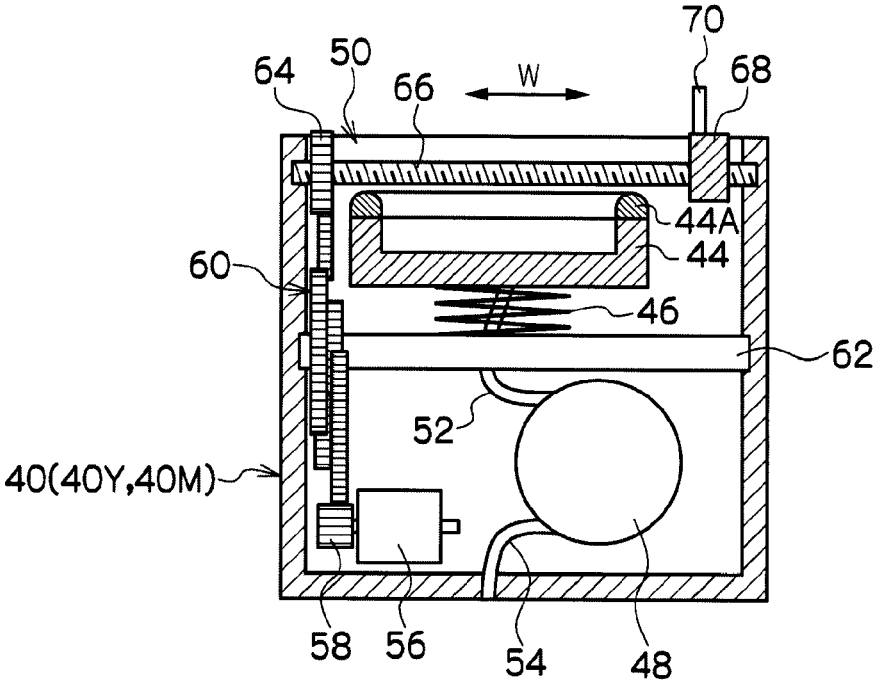

As shown in FIG. 4A and FIG. 4B, each of the maintenance units 40 includes a cap 44 for each color, a coil spring 46 that serves as urging member, a wiper blade 70 that serves as a wiping member, a suction pump 48 that places the interior of the cap 44 in negative pressure, a flexible tube 52 that interconnects the cap 44 and the suction pump 48, a flexible tube 54 that interconnects the suction pump 48 and the atmosphere, and a moving mechanism 50. The caps 44 cover the nozzle surfaces 24 to prevent drying of the ink inside the nozzles 22 and protect the nozzle surfaces 24 (the nozzles 22). The coil springs 46 urges the caps 44 in the substantially up direction. The wiper blades 70 wipe the nozzles surfaces 24 of the inkjet recording heads 20Y to 20K for each color. The moving mechanisms 50 cause the wiper blades 70 to move at a predetermined velocity V (e.g., V=about 20 mm/sec to about 80 mm/sec) in the conveyance direction of the recording paper P and in the reverse direction of the conveyance direction.

Each of the moving mechanisms 50 is mainly configured by a motor 56 that serves as a drive source that is capable of rotational driving in both forward and reverse directions, a gear 58 that is fixed to a rotating shaft of the motor 56, a gear group 60 that meshes with the gear 58 and transmits the rotational drive force thereof, a shaft 62 (in FIG. 4A and FIG. 4B, just one is shown for simplicity for understanding) that rotatably supports the gear group 60, a ball screw 66 that is inserted through a blade holder 68 of the wiper blade 70 by screw action, and a gear 64 that is fixed to the ball screw 66 and meshes with the gear group 60.

Thus, the ball screw 66 rotates in both forward and reverse directions due to the rotation of the motor 56 in both forward and reverse directions, whereby the wiper blade 70 can reciprocally move in the direction of arrow W that is shown in FIGS. 4A and 4B (i.e., in the conveyance direction of the recording paper P and in the reverse direction of the conveyance direction). A rib portion 44A that is formed by an elastic body is disposed at the peripheral edge portion (the top surface) of the cap 44. During capping with respect to the inkjet recording heads 20, the rib portions 44A tightly contact the nozzle surfaces 24 on the peripheries of the nozzles 22 that are one-dimensionally arrayed, whereby the rib portions 44A form sealed spaces.

The inkjet recording heads 20Y to 20K of the respective colors are disposed such that they are the same distance away from the peripheral surface of the conveyance drum 30. As described above, the inkjet recording heads 20 are disposed such that their nozzle surfaces 24 are inclined so as to correspond to the peripheral surface of the conveyance drum 30. In FIG. 3, the cyan (C) and black (K) inkjet recording heads 20C and 20K are disposed such that their nozzle surfaces 24 slant downward to the left, and the yellow (Y) and magenta (M) inkjet recording heads 20Y and 20M are disposed such that their nozzle surfaces 24 incline downward to the right.

Consequently, the maintenance units 40C and 40K for the cyan (C) and black (K) inkjet recording heads 20C and 20K are the type shown in FIG. 4A, and the maintenance units 40Y and 40M for the yellow (Y) and magenta (M) inkjet recording heads 20Y and 20M are the type shown in FIG. 4B.

Figure 5:
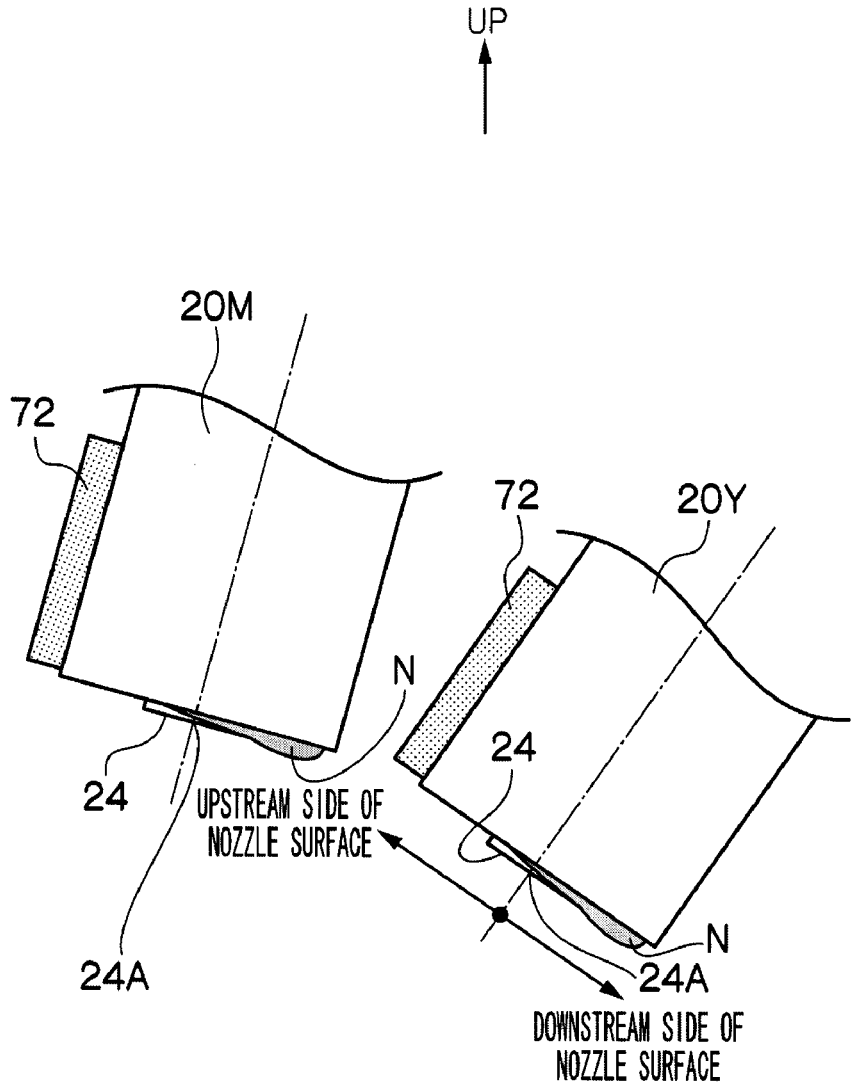
FIG. 5 is a schematic side view showing a state where ink that has been exuded from nozzles flows due to the force of gravity.
Figure 6:
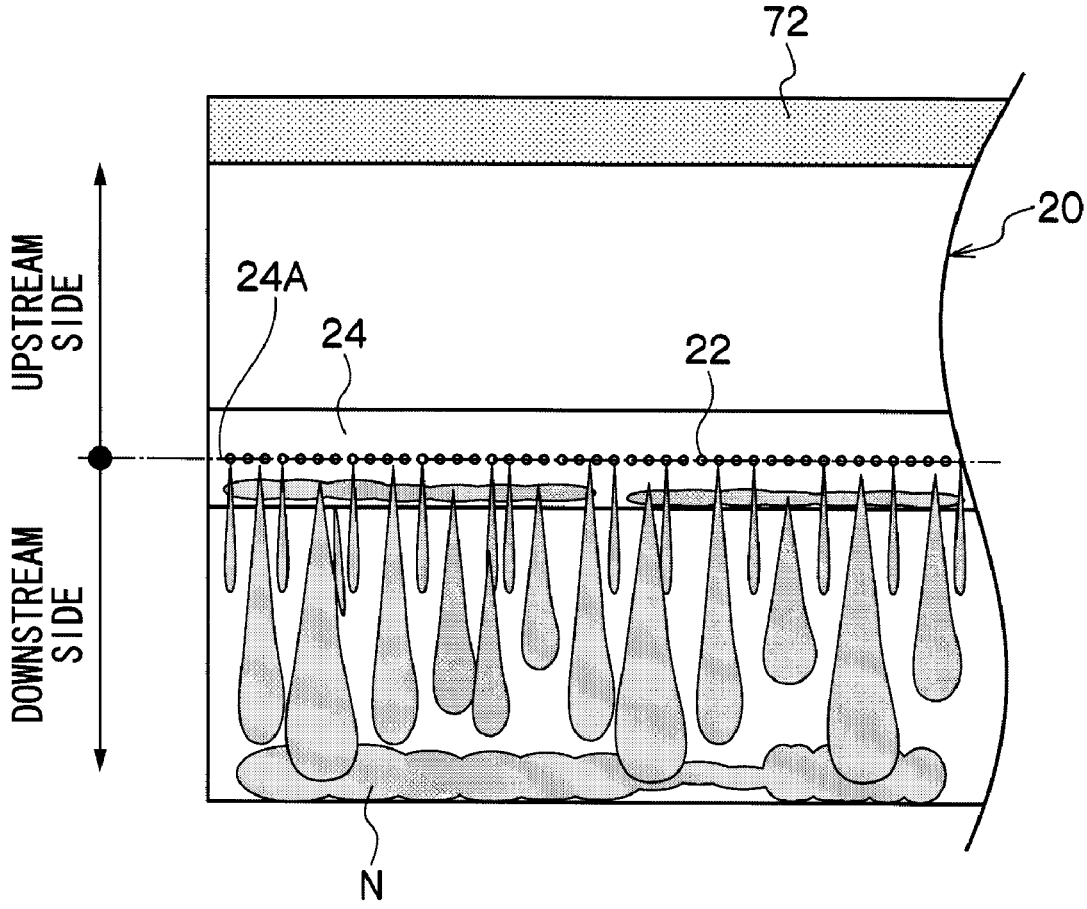
FIG. 6 is a schematic bottom view showing a state where ink that has been exuded from the nozzles flows due to the force of gravity.

In other words, two types of the maintenance units 40Y to 40K are (bilaterally symmetrically) disposed such that, in an initial state, as shown in FIG. 5 and FIG. 6, when the ink N is exuded from the nozzles 22 of the inkjet recording heads 20Y to 20K (in FIG. 5, just the inkjet recording heads 20Y and 20M are shown as an example), the wiper blades 70 can be disposed at the downstream side, which is the direction in which the ink N flows due to the force of gravity.

Absorbers 72 that absorb and remove excess ink (including thickened/solidified ink and ink that includes air bubbles) and the like trapped by the wiper blades 70 are attached to the front surfaces of the inkjet recording heads 20 on the downstream sides in a wiping direction of the wiper blades 70 (on the upstream sides of the nozzle surfaces 24 in liquid flow direction).

That is, the absorbers 72 are attached to the front surfaces on the downstream side in the conveyance direction of the recording paper P in the case of the cyan (C) and black (K) inkjet recording heads 20C and 20K, and the absorbers 72 are attached to the front surfaces on the upstream side in the conveyance direction of the recording paper P in the case of the yellow (Y) and magenta (M) inkjet recording heads 20Y and 20M (see FIG. 3).

The wiper blades 70 are formed by an elastic body that includes a rubber material such as NBR (nitrile butadiene rubber), silicone rubber and EPDM (ethylene propylene diene monomer) rubber, or a thermoplastic elastomer such as silicon, olefin, or polyester materials. The wiper blades 70 are configured to slidingly contact, in a bent state, the nozzle surfaces 24 of the inkjet recording heads 20Y to 20K of each color with a predetermined pressure in accompaniment with the movement of the blade holders 68.

Next, a first example of maintenance operation by the maintenance units 40 configured as described above will be described mainly on the basis of FIG. 7A to FIG. 7E and FIG. 8A and FIG. 8B. First, the recording paper P is supplied onto the peripheral surface of the conveyance drum 30 by the pickup roller 28 and the conveyance roller pairs 32. The recording paper P that has been supplied onto the peripheral surface of the conveyance drum 30 and is attracted to and held on the conveyance drum 30 is supplied to recording positions of the inkjet recording heads 20, and an image is recorded on the printing surface of the recording paper P. After completion of image recording, the recording paper P is separated from the conveyance drum 30 and is conveyed by the conveyance roller pairs 38 to the paper discharge section 18.

Here, when a command for implementing suction recovery is issued and maintenance operation (suction recovery) is to be performed with respect to the inkjet recording heads 20Y to 20K, first, the inkjet recording heads 20Y to 20K rise a predetermined height in the direction of arrow H (see FIG. 2) and move a predetermined distance away from the peripheral surface of the conveyance drum 30. Thus, a space into which the maintenance units 40 (the maintenance unit holder 42) are capable of entering is formed between the peripheral surface of the conveyance drum 30 and the nozzle surfaces 24 of the inkjet recording heads 20Y to 20K.

Thereafter, the maintenance units 40 (the maintenance unit holder 42) are caused to enter that space, and the inkjet recording heads 20 are moved downward a predetermined amount in the direction in which the inkjet recording heads 20 approach the caps 44 of the maintenance units 40. At this time, the caps 44 are urged substantially upward by the coil springs 46. Therefore, the rib portions 44A of the caps 44 (see FIG. 4A and FIG. 4B) tightly contact the nozzle surfaces 24 of the inkjet recording heads 20, and the entireties of the nozzles 22 that are formed in the nozzle surfaces 24 (the entire region in the width direction of the recording paper P) are covered.

In this manner, when the caps 44 cover the entireties of the nozzles 22, recovery such as ink suction is performed. That is, the interior of the caps 44 are placed in negative pressure by the suction pumps 48, and the ink inside the nozzles 22 is suctioned. When suction recovery completes, the inkjet recording head 20 again rise and the caps 44 move away from the nozzle surfaces 24 (capping is released).

Figures 7A, 7B, 7C, 7D, 7E:
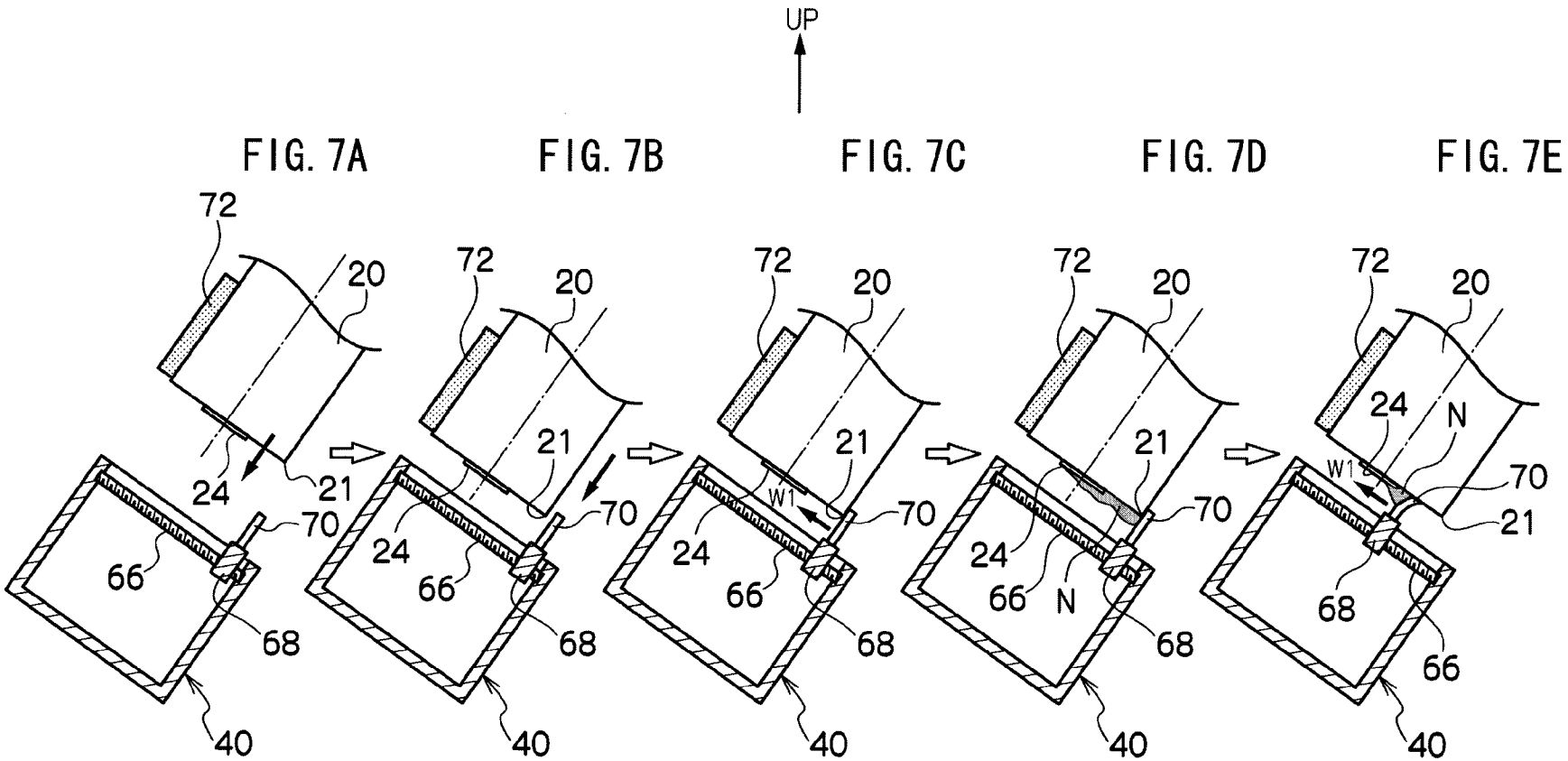
FIG. 7A to FIG. 7E are schematic side views showing a first example of maintenance operation by a wiper blade.

Next, as shown in FIG. 7A and FIG. 7B, the inkjet recording heads 20 are moved downward toward positions where the inkjet recording head 20 are capable of being wiped by the wiper blades 70 and, as shown in FIG. 7C, the wiper blades 70 are moved a predetermined amount in the wiping direction (the direction of arrow W1) such that the wiper blades 70 are brought into contact with the front surfaces including corner portions 21 (the downstream side end portions of the nozzle surfaces 24) of the inkjet recording heads 20. Thereafter, as shown in FIG. 7D, the ink N is exuded for a predetermined amount of time from all of the nozzles 22 of the inkjet recording heads 20.

As exuding units that exude the ink N, drivers that drive piezoelectric elements (not shown) that apply energy to the inkjet recording heads 20 to an extent that ink droplets are not ejected from the nozzles 22, or pressurizers that apply positive pressure from the ink tanks 26 to pressurize the ink inside the inkjet recording heads 20, are conceivable.

When the ink N is exuded from the nozzles 22, the ink N flows downward due to the force of gravity, but the wiper blades 70 are stopped on the downstream sides of the nozzle surfaces 24 in a state where the wiper blades 70 contact the front surfaces including the corner portions 21 of the inkjet recording heads 20. For that reason, the ink N is held by the wiper blades 70 and is prevented from flowing off into the interior of the inkjet recording apparatus 10. In this manner, when the ink N adheres to mainly the downstream side peripheries of the nozzle surfaces 24, wiping by the wiper blades 70 is started.

That is, as shown in FIG. 7E, the wiper blades 70 move forward in the direction of arrow W1 by the rotational driving of the ball screws 66 via the blade holders 68. Then, as shown in FIG. 8A, the ink N is held and carried to the upstream sides of the nozzle surfaces 24 by the wiper blades 70 that had been disposed at the downstream sides of the nozzle surfaces 24, whereby the entire nozzle surfaces 24 are moistened (across their entire regions in the width direction of the recording paper P) and wiped.

Thus, excess ink (including thickened/solidified ink and ink that includes air bubbles) and dust (foreign matter) that had remained on the peripheries of the nozzles 22 (the nozzle surfaces 24) are dissolved by the ink N, wiped by the wiper blades 70 and removed from the nozzle surfaces 24. The excess ink and dust (foreign matter) that have been removed by the wiper blades 70 are, as shown in FIG. 8B, absorbed/removed by the absorbers 72 that are disposed at the front surfaces of the inkjet recording heads 20 (on the downstream sides in the wiping direction of the wiper blades 70). As a result, the occurrence of ejection problems is controlled or prevented.

After the entire nozzle surfaces 24 are wiped by the wiper blades 70 in this manner, the inkjet recording heads 20 rise by a predetermined height where the nozzle surfaces 24 do not contact the wiper blades 70, and the wiper blades 70 move back by the reverse rotational driving of the motors 56. In other words, the ball screws 66 reversely rotate, the blade holders 68 move back, and the wiper blades 70 stand by until the next wiping.

When the maintenance operation with respect to the inkjet recording heads 20Y to 20K ends, the maintenance units 40 (the maintenance unit holder 42) are moved to their original standby position, and the inkjet recording heads 20Y to 20K are moved downward toward the peripheral surface of the conveyance drum 30 at positions where the inkjet recording heads 20 are capable of printing. Thus, all operations before the start of printing are completed, and the inkjet recording heads 20Y to 20K again become capable of printing.

Next, a second example of maintenance operation by the maintenance units 40 will be described mainly on the basis of FIG. 9A to FIG. 9E. It will be noted that the series of operations until wiping by the wiper blades 70 is the same as that of the first example, so detailed description thereof will be omitted. In order for wiping by the wiper blades 70 to be performed, as shown in FIG. 9A and FIG. 9B, the inkjet recording heads 20 are moved downward toward positions where the inkjet recording heads 20 are capable of being wiped by the wiper blades 70.

Figures 9A, 9B, 9C, 9D, 9E:
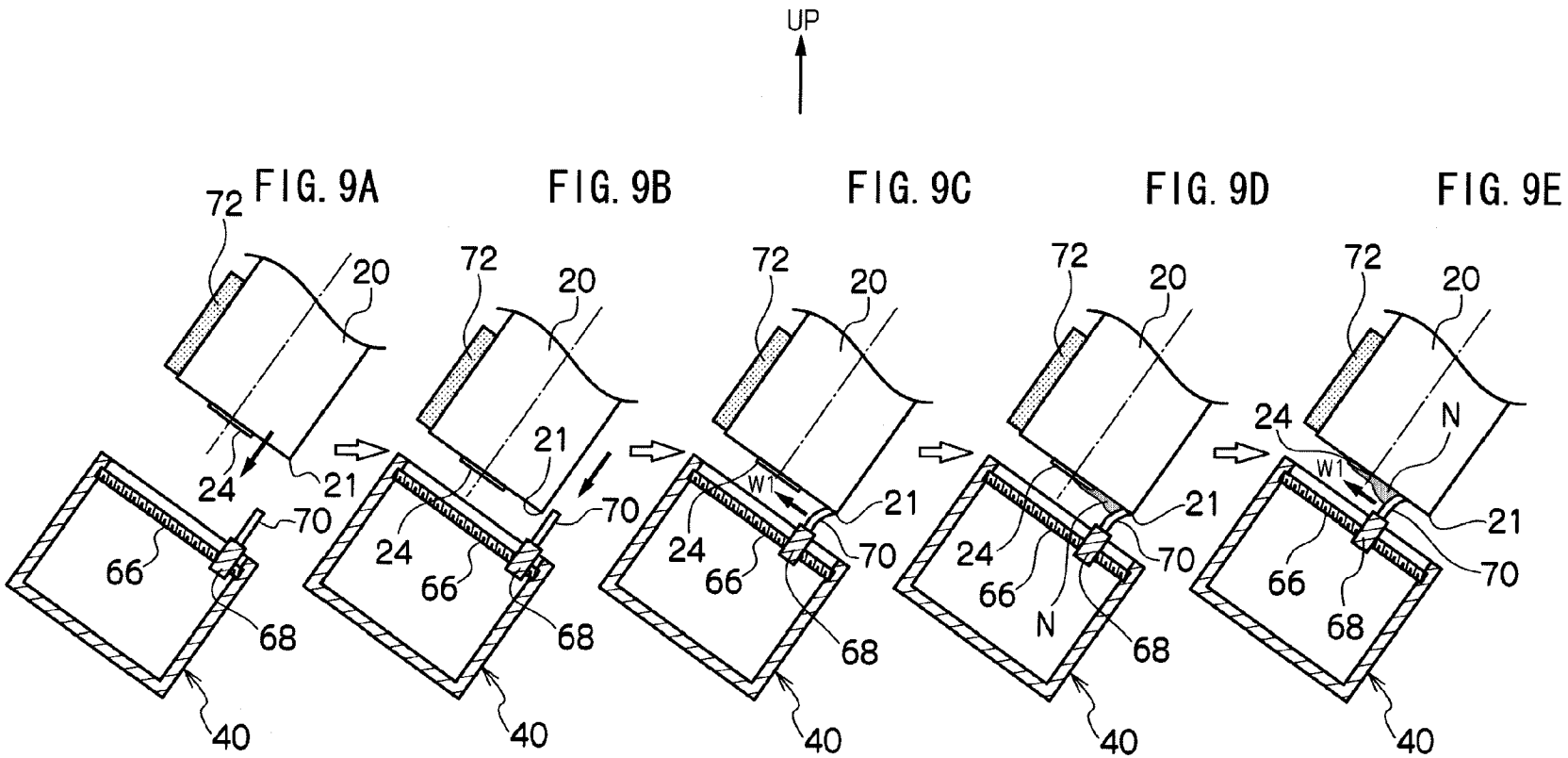
FIG. 9A to FIG. 9E are schematic side views showing a second example of maintenance operation by the wiper blade.

Then, as shown in FIG. 9C, the wiper blades 70 are moved by a predetermined amount in the wiping direction (the direction of arrow W1) such that the wiper blades 70 are brought into contact with the downstream side end portions of the nozzle surfaces 24 of the inkjet recording heads 20. Thus, the wiper blades 70 are flexurally deformed such that their distal end portions face further outward (the downstream sides) than the corner portions 21 of the inkjet recording heads 20. Thereafter, as shown in FIG. 9D, the ink N is exuded for a predetermined amount of time from all of the nozzles 22 of the inkjet recording heads 20.

When the ink N is exuded from the nozzles 22, the ink N flows downward due to the force of gravity, but the wiper blades 70 are stopped on the downstream sides of the nozzles surfaces 24 and contact, in a bent state, the nozzle surfaces 24 of the inkjet recording heads 20. For that reason, the ink N is held by the wiper blades 70 and is prevented from flowing off into the interior of the inkjet recording apparatus 10. In this manner, when the ink N adheres to mainly the downstream side peripheries of the nozzle surfaces 24, wiping by the wiper blades 70 is started.

That is, as shown in FIG. 9E, the wiper blades 70 move forward in the direction of arrow W1 by the rotational driving of the ball screws 66 via the blade holders 68. When the wiper blades 70 that had been disposed at the downstream sides of the nozzle surfaces 24 move in the wiping direction, as shown in FIG. 8A, the ink N is held and carried to the upstream sides of the nozzle surfaces 24 by the wiper blades 70, whereby the entire nozzle surfaces 24 are moistened (across their entire regions in the width direction of the recording paper P) and wiped.

Thus, excess ink (including thickened/solidified ink and ink that includes air bubbles) and dust (foreign matter) that had remained on the peripheries of the nozzles 22 (the nozzle surfaces 24) are dissolved by the ink N, wiped by the wiper blades 70 and removed from the nozzle surfaces 24. The excess ink and dust (foreign matter) that have been removed by the wiper blades 70 are, as shown in FIG. 8B, absorbed/removed by the absorbers 72 that are disposed at the front surfaces of the inkjet recording heads 20 (on the downstream sides in the wiping direction of the wiper blades 70). As a result, the occurrence of ejection problems is controlled or prevented.

After the entire nozzle surfaces 24 are wiped by the wiper blades 70 in this manner, similar to the first example, the inkjet recording heads 20 rise by a predetermined height where the nozzle surfaces 24 do not contact the wiper blades 70, and the wiper blades 70 move back by the reverse rotational driving of the motors 56. In other words, the ball screws 66 reversely rotate, the blade holders 68 move back, and the wiper blades 70 stand by until the next wiping.

When the maintenance operation with respect to the inkjet recording heads 20Y to 20K ends, the maintenance units 40 (the maintenance unit holder 42) are moved to their original standby position, and the inkjet recording heads 20Y to 20K are moved downward toward the peripheral surface of the conveyance drum 30 at positions where the inkjet recording heads 20 are capable of printing. Thus, all operations before the start of printing are completed, and the inkjet recording heads 20Y to 20K again become capable of printing.

Next, a third example of maintenance operation by the maintenance units 40 will be described mainly on the basis of FIG. 10A to FIG. 10E. It will be noted that the series of operations until wiping by the wiper blades 70 is the same as that of the first example, so detailed description thereof will be omitted. Further, in the case of this third example, the blade holders 68 of the wiper blades 70 are diagonally disposed (inclined) with respect to the ball screws 66.

That is, the blade holders 68 are disposed at the ball screws 66 in a state where the blade holders 68 are tilted in the opposite direction of the wiping direction such that, in an initial state, the distal end portions of the wiper blades 70 orient further outward (the downstream sides of the nozzle surfaces 24) than the corner portions 21 of the inkjet recording heads 20 (the downstream side end portions of the nozzle surfaces 24), or in other words, such that an angle θ formed by the nozzle surfaces 24 and the wiper blades 70 (see FIG. 10C) becomes equal to or less than 90 degrees.

Figures 10A, 10B, 10C, 10D, 10E:
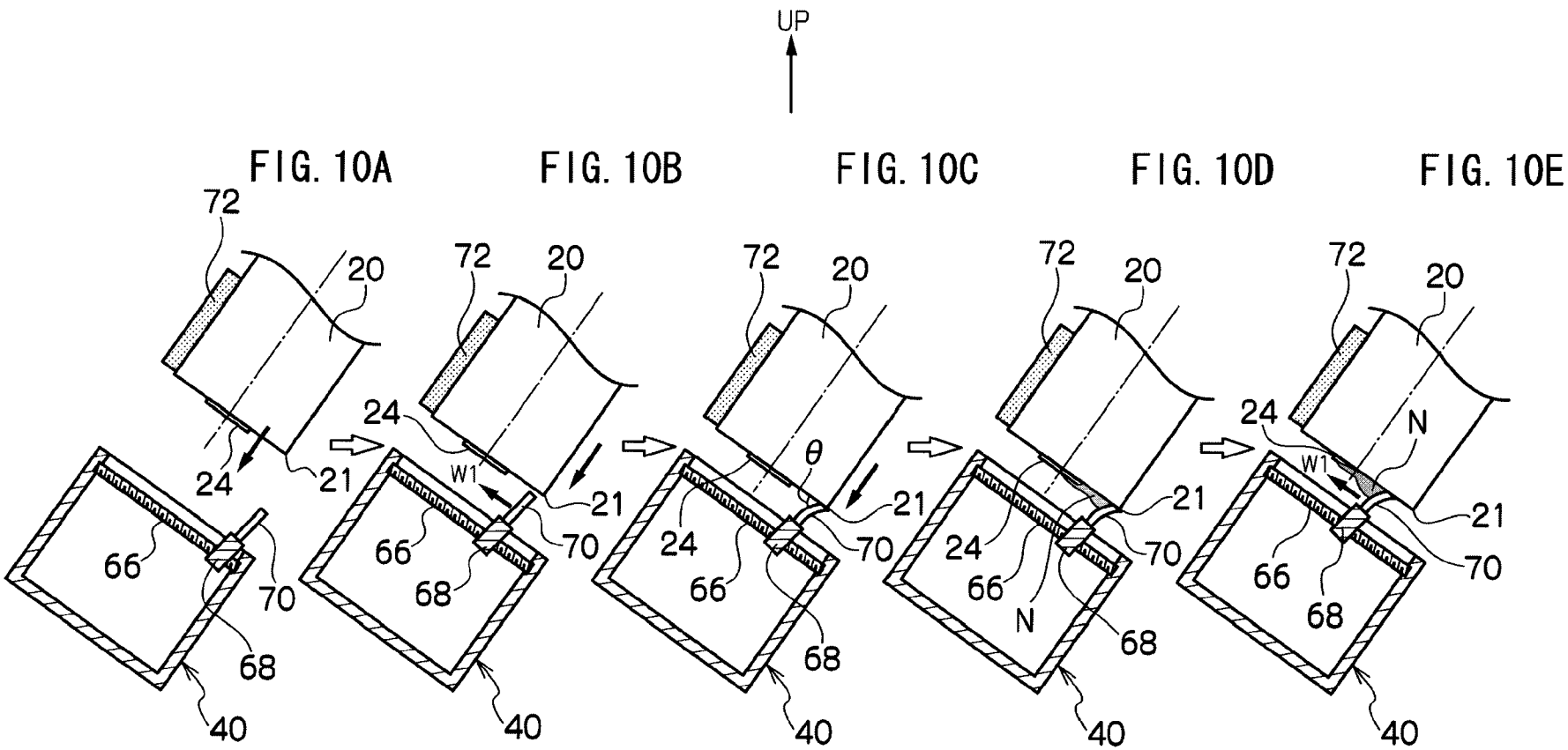
FIG. 10A to FIG. 10E are schematic side views showing a third example of maintenance operation by the wiper blade.

In order for wiping by the wiper blades 70 to be performed, first, as shown in FIG 10A and FIG 10B, the inkjet recording heads 20 are moved downward by a predetermined amount just short of positions where the inkjet recording heads 20 are capable of being wiped by the wiper blades 70. Then, as shown in FIG. 10B, the wiper blades 70 are moved by a predetermined amount in the wiping direction (the direction of arrow W1) and stopped.

Thereafter, the inkjet recording heads 20 are moved downward to positions where the inkjet recording heads 20 are capable of being wiped by the wiper blades 70, such that the wiper blades 70 are brought into contact with the downstream side end portions of the nozzle surfaces 24 of the inkjet recording heads 20. At this time, the distal end portions of the wiper blades 70 are disposed such that they are inclined beforehand so as to orient further outward (the downstream sides) than the corner portions 21 of the inkjet recording heads 20. For that reason, when the distal end portions of the wiper blades 70 contact the downstream side end portions of the nozzle surfaces 24, the distal end portions of the wiper blades 70 are flexurally deformed such that they are inclined further outward (toward the downstream sides of the nozzle surfaces 24) than the corner portions 21 of the inkjet recording heads 20.

Thereafter, as shown in FIG. 10D, the ink N is exuded for a predetermined amount of time from all of the nozzles 22 of the inkjet recording heads 20. When the ink N is exuded from the nozzles 22, the ink N flows downward due to the force of gravity, but the wiper blades 70 are stopped on the downstream sides of the nozzle surfaces 24 and contact, in a bent state, the nozzle surfaces 24 of the inkjet recording heads 20. For that reason, the ink N is held by the wiper blades 70 and is prevented from flowing off into the interior of the inkjet recording apparatus 10. In this manner, when the ink N adheres to mainly the downstream side peripheries of the nozzle surfaces 24, wiping by the wiper blades 70 is started.

That is, as shown in FIG. 10E, the wiper blades 70 move forward in the direction of arrow W1 by the rotational driving of the ball screws 66 via the blade holders 68. When the wiper blades 70 that had been disposed at the downstream sides of the nozzle surfaces 24 move in the wiping direction, as shown in FIG. 8A, the ink N is held and carried to the upstream sides of the nozzle surfaces 24 by the wiper blades 70, whereby the entire nozzle surfaces 24 are moistened (across their entire regions in the width direction of the recording paper P) and wiped.

Thus, excess ink (including thickened/solidified ink and ink that includes air bubbles) and dust (foreign matter) that had remained on the peripheries of the nozzles 22 (the nozzle surfaces 24) are dissolved by the ink N, wiped by the wiper blades 70 and removed from the nozzle surfaces 24. The excess ink and dust (foreign matter) that have been removed by the wiper blades 70 are, as shown in FIG. 8B, absorbed/removed by the absorbers 72 that are disposed at the front surfaces of the inkjet recording heads 20 (on the downstream sides in the wiping direction of the wiper blades 70). As a result, the occurrence of ejection problems is controlled or prevented.

After the entire nozzle surfaces 24 are wiped by the wiper blades 70 in this manner, similar to the first example, the inkjet recording heads 20 rise by a predetermined height where the nozzle surfaces 24 do not contact the wiper blades 70, and the wiper blades 70 move back by the reverse rotational driving of the motors 56. In other words, the ball screws 66 reversely rotate, the blade holders 68 move back, and the wiper blades 70 stand by until the next wiping.

When the maintenance operation with respect to the inkjet recording heads 20Y to 20K ends, the maintenance units 40 (the maintenance unit holder 42) are moved to their original standby position, and the inkjet recording heads 20Y to 20K are moved downward toward the peripheral surface of the conveyance drum 30 at positions where the inkjet recording heads 20 are capable of printing. Thus, all operations before the start of printing are completed, and the inkjet recording heads 20Y to 20K again become capable of printing.

It will be noted that, in this third example, since the wiper blades 70 are not brought into contact with the corner portions 21 of the inkjet recording heads 20, wear of the wiper blades 70 resulting from the wiper blades 70 slidingly contacting the corner portions 21 can be reduced. Further, the corner portions 21 can also be prevented from becoming dirtied by the ink N.

Figure 11:
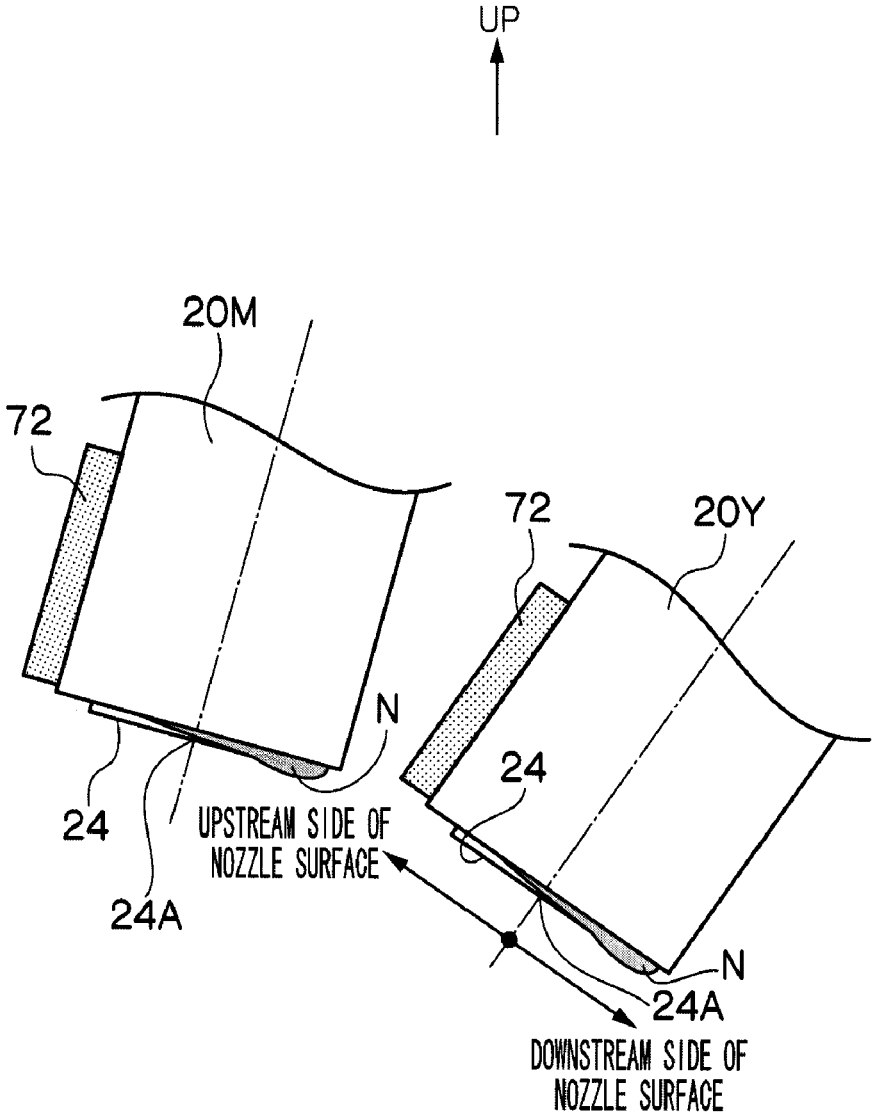
FIG. 11 is a schematic side view showing a state where ink that has been exuded from the nozzles flows due to the force of gravity.
Figure 12:
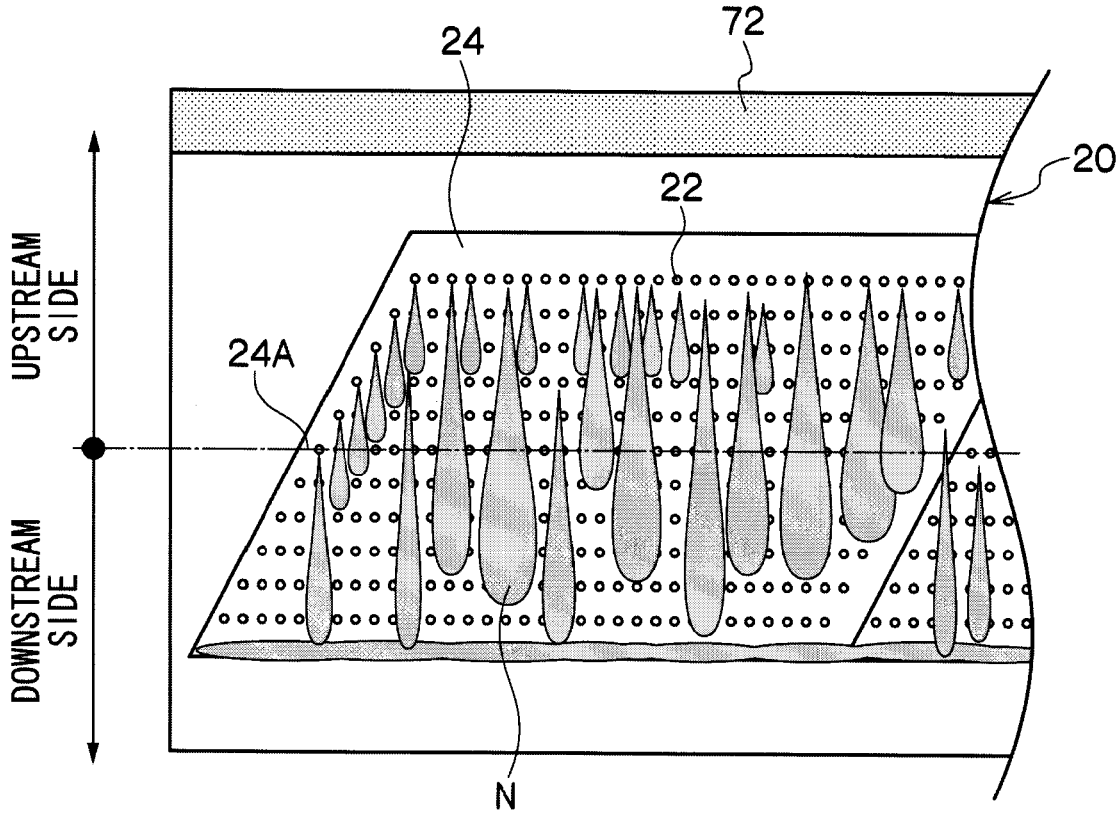
FIG. 12 is a schematic bottom view showing a state where ink that has been exuded from the nozzles flows due to the force of gravity.

In the first example to the third example, the one-dimension array nozzle surfaces 24 where the nozzles 22 are formed in one row have been described. However, as shown in FIG. 11 and FIG. 12, these examples (exemplary embodiments) can be also applied to the nozzle surfaces 24 arrayed two-dimensionally where the nozzles 22 are formed in a matrix in order to increase printing speed and resolution. However, in this case, it suffices for the ink N to be exuded from specific nozzles 22 on the upstream sides or the downstream sides of the center positions 24A of the nozzle surfaces 24 in the conveyance direction of the recording paper P, and it is not invariably necessary for the ink N to be exuded from all of the nozzles 22.

That is, when the ink N is exuded from specific nozzles 22 on the upstream sides, the ink N flows from the upstream sides to the downstream sides due to the force of gravity, so the nozzles 22 on the downstream sides are naturally moistened. In this case, the nozzle surfaces 24 are moistened (across the width direction of the recording paper P) even when the wiper blades 70 do not perform wiping. In this manner, it is not necessary to exude the ink N from the nozzles 22 on the downstream sides whose peripheries are moistened by the ink N that exudes from the nozzles 22 on the upstream sides.

On the other hand, when the ink N is exuded from specific nozzles 22 on the downstream sides, similar to when the nozzles 22 are one-dimensionally arrayed, the entire nozzle surfaces 24 are moistened (across the width direction of the recording paper P) by the wiping of the wiper blades 70 (as a result of the wiper blades 70 holding and carrying the ink N to the upstream sides). In this case, similar to when the nozzles 22 are one-dimensionally arrayed, it suffices for the ink N to be exuded at least from the specific nozzles 22 such that the ink N is continuously held across the width direction of the recording paper P between the wiper blades 70 and the nozzles surfaces 24.

It will be noted that, when, for example, piezoelectric elements (not shown) that apply energy to the inkjet recording heads 20 to an extent that ink droplets are not ejected from the nozzles 22 are driven as an exuding unit, it suffices for just those nozzles 22 that become targets to be driven.

Further, when positive pressure is applied from the ink tanks 26 to pressurize the ink inside the inkjet recording heads 20 for exuding, it suffices for the inkjet recording heads 20 to be configured such that the flow paths of the ink are divided inside the inkjet recording heads 20 and the pressurized pressure is divided and imparted only to the target nozzles 22.

Figure 13:
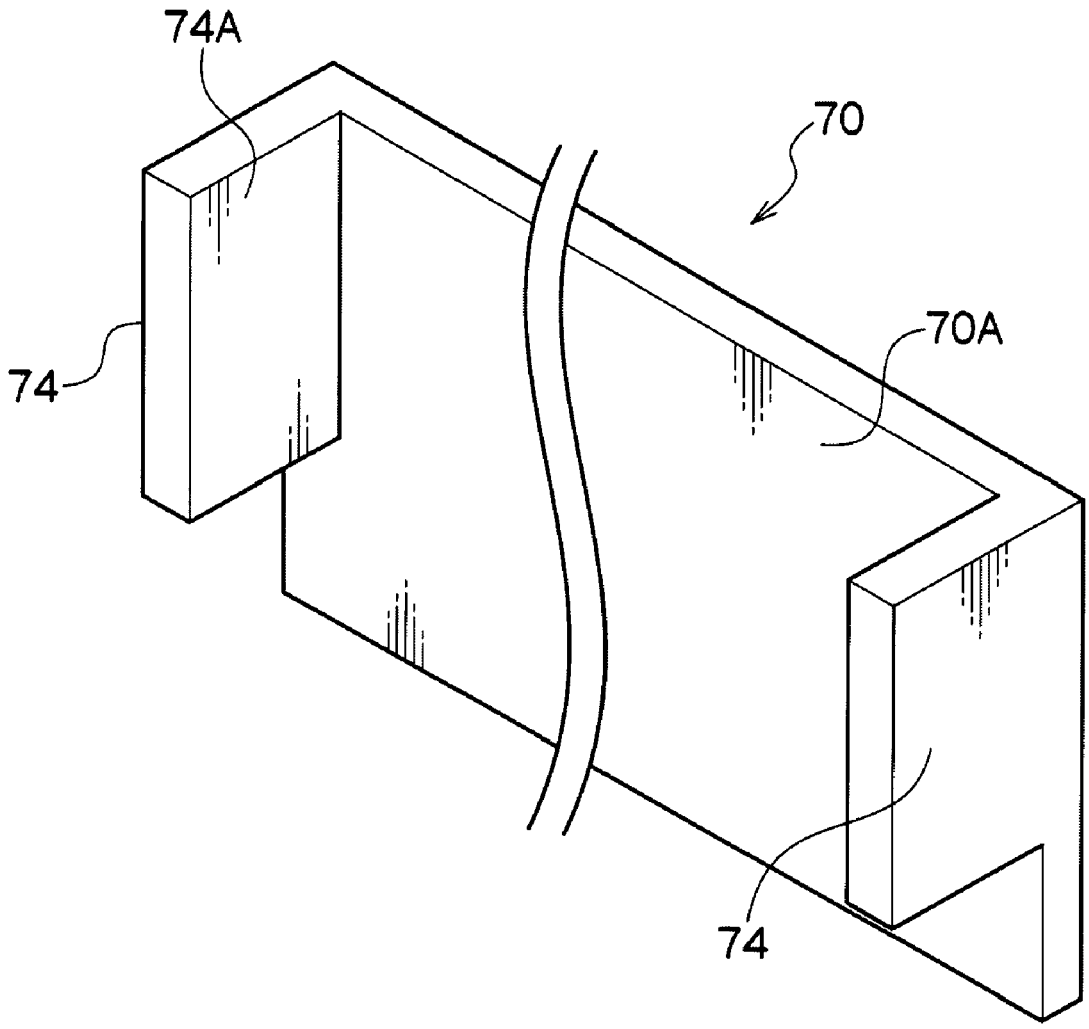
FIG. 13 is a schematic perspective view showing a first modification of the wiper blade.
Figure 14:
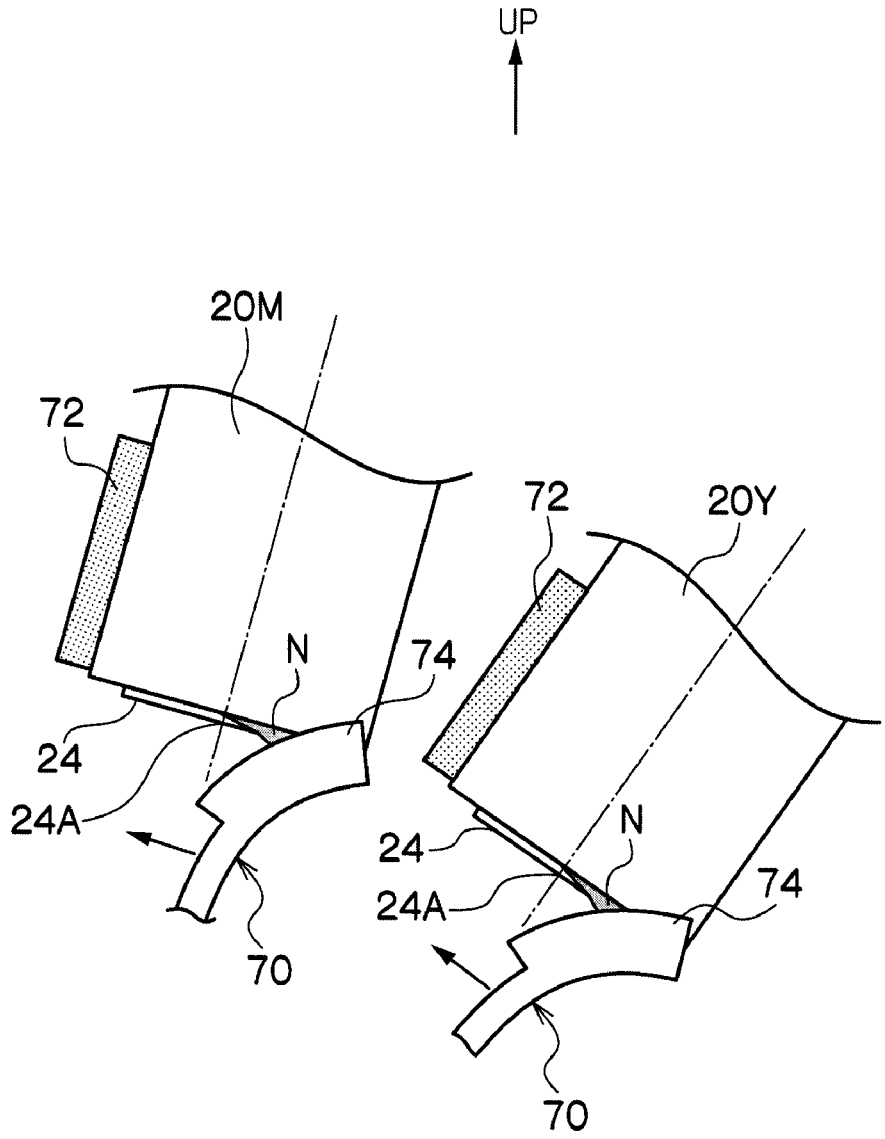
FIG. 14 is a schematic side view showing wiping action by the wiper blade of the first modification.

The wiper blades 70 may also be formed in the shape shown in FIG. 13. That is, projecting (wall) portions 74 that project vertically with respect to wiping surfaces 70A in the wiping direction may also be disposed at both end portions (both end portions in the width direction of the recording paper P) of each of the wiper blades 70. The projecting portions 74 are integrally formed in rectangular shapes when seen from the side such that, as shown in FIG. 14, when the wiper blades 70 wipe the nozzle surfaces 24, inner surfaces 74A of the projecting portions 74 slidingly contact the side surfaces (the surfaces that face the width direction of the recording paper P) of the inkjet recording heads 20.

The projecting portions 74 are not limited to a configuration where they project vertically with respect to the wiping surfaces 70A and may also project at an angle where the intervals between their inner surfaces 74A widen. Further, the projecting portions 74 are not limited to being integrally formed on both end portions of each of the wiper blades 70 and may also be configured such that they are attached by joining means such as an adhesive to both end portions of each of the wiper blades 70. Moreover, the wiper blades 70 may also be configured such that convex portions (not shown) are formed in predetermined positions on the inner surfaces 74A of the projecting portions 74 to reduce sliding contact resistance with the side surfaces of the inkjet recording heads 20.

Due to these projecting portions 74, the ink N can be prevented from flowing off from both end portions of each of the wiper blades 70. Moreover, because the inner surfaces 74A of the projecting portions 74 slidingly contact the side surfaces (the surfaces that face the width direction of the recording paper P) of the inkjet recording heads 20, the ink N can be prevented from running around to the upstream sides in the wiping direction of the wiper blades 70 from between the projecting portions 74 of the wiper blades 70 and the side surfaces of the inkjet recording heads 20.

Figure 15:
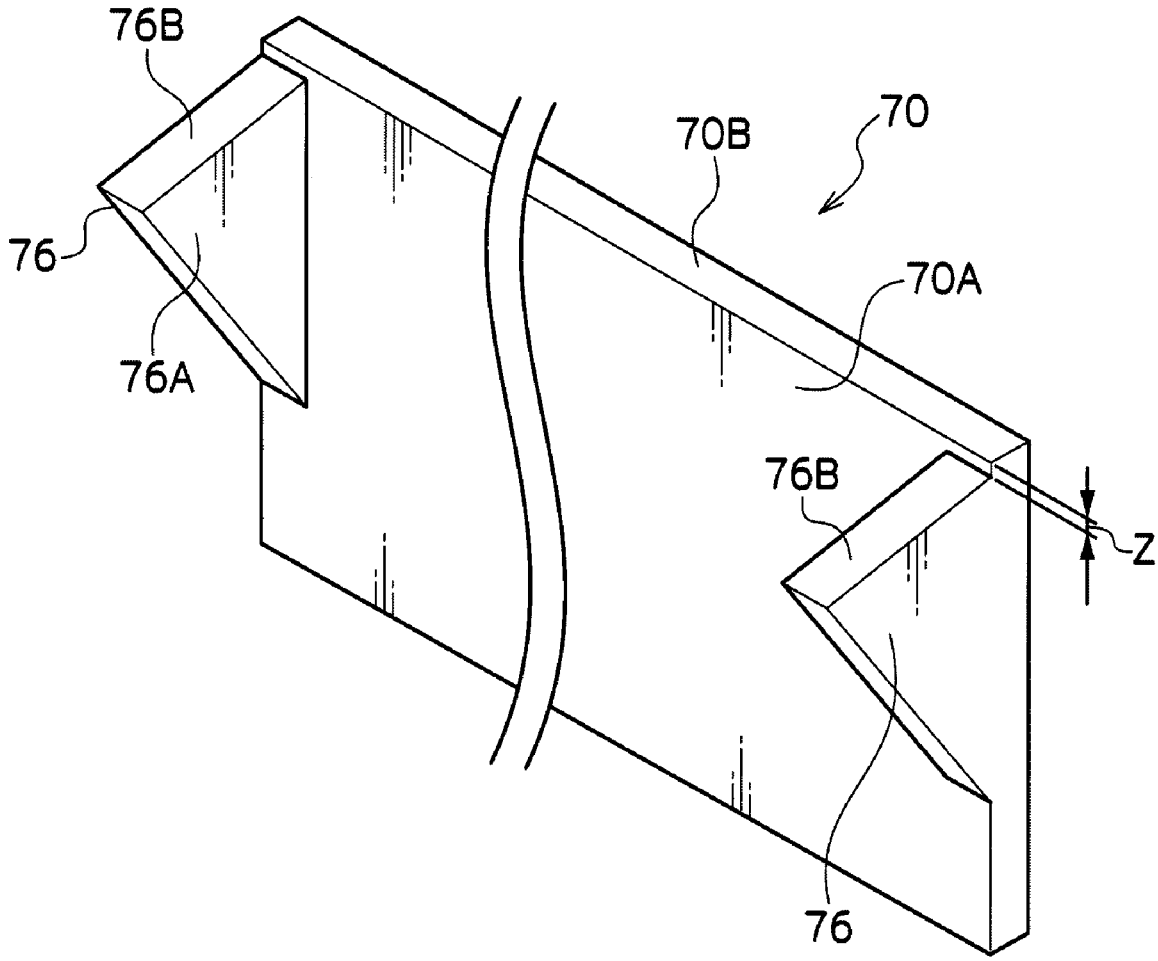
FIG. 15 is a schematic perspective view showing a second modification of the wiper blade.

The wiper blades 70 may also be formed in the shape shown in FIG. 15. That is, projecting (wall) portions 76 that project vertically with respect to the wiping surfaces 70A in the wiping direction may also be disposed at both end portions (both end portions in the width direction of the recording paper P) of each of the wiper blades 70 and in positions a predetermined amount Z (e.g., Z=about 0.2 mm to about 0.4 mm) away from distal end surfaces 70B of the wiper blades 70.

Figure 16:
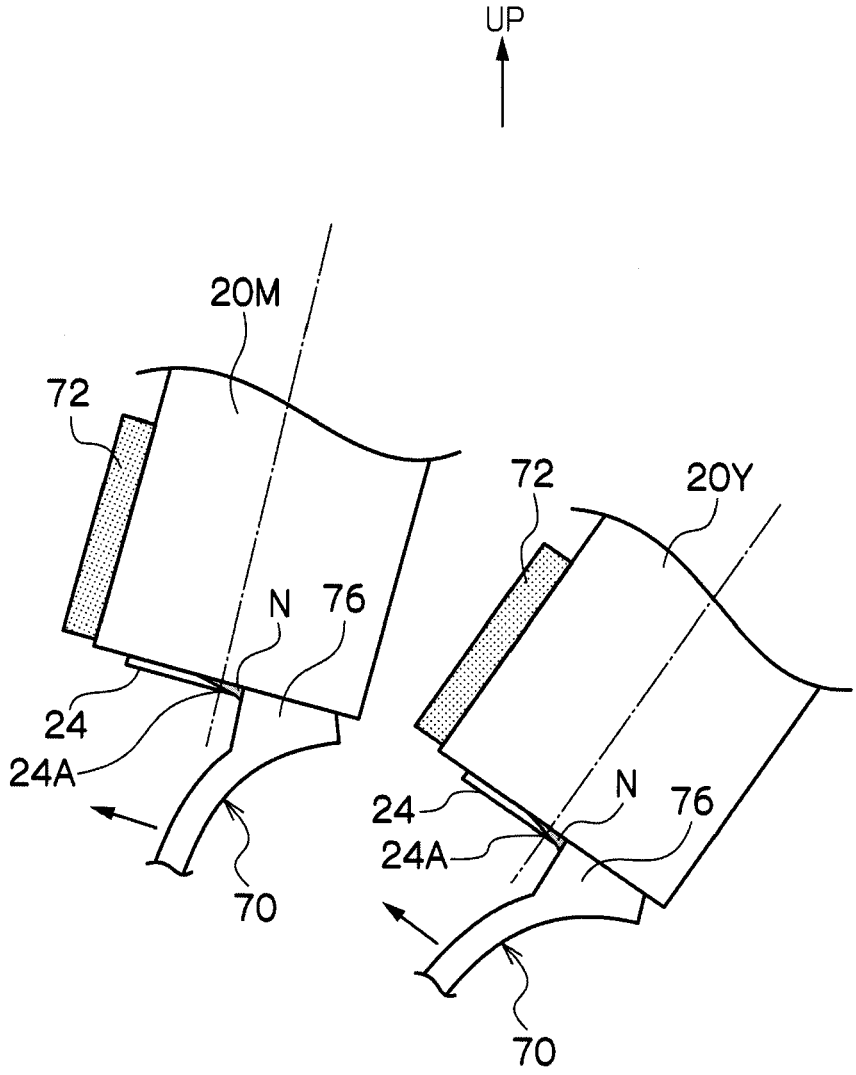
FIG. 16 is a schematic side view showing wiping action by the wiper blade of the second modification.

The projecting portions 76 are integrally formed in triangular shapes when seen from the side, and the predetermined amount Z is formed between upper surfaces 76B of the projecting portions 76 and the distal end surfaces 70B. Thus, as shown in FIG. 16, when the wiper blades 70 wipe the nozzle surfaces 24 (when the wiper blades 70 bend), the upper surfaces 76B slidingly contact both end portions (both end portions in the width direction of the recording paper P) of the nozzle surfaces 24 where the nozzles 22 are not formed.

The projecting portions 76 are also not limited to a configuration where they project vertically with respect to the wiping surfaces 70A and may also project at an angle where the intervals between their inner surfaces 76A widen. Further, the projecting portions 76 are not limited to being integrally formed on both end portions of each of the wiper blades 70 and may also be configured such that they are attached by joining means such as an adhesive to both end portions of each of the wiper blades 70.

Because of these projecting portions 76 also, the ink N can be prevented from flowing off from both end portions of each of the wiper blades 70 and can be prevented from running around to the upstream sides in the wiping direction of the wiper blades 70.

The wiper blades 70 pertaining to the exemplary embodiments have been described above, but the wiper blades 70 may also be configured to move along the nozzles 22 shown in FIG. 12 in a diagonal direction from the downstream sides to the upstream sides of those nozzle surfaces 24 and wipe the nozzle surfaces 24, for example. Further, the moving mechanisms 50 that cause the blade holders 68 to reciprocally move are not limited to the ball screws 66 as described above and may also employ an arbitrary configuration, such as an unillustrated rack-and-pinion or endless belt.

It suffices for the amount of the ink N that is exuded from the nozzles 22 to be an amount where the ink N does not flow off into the interior of the inkjet recording apparatus 10 in a state where the wiper blades 70 contact the front surfaces including the corner portions 21 of the inkjet recording heads 20 or the downstream side end portions of the nozzle surfaces 24. The amount of the ink N that is exuded from the nozzles 22 may also be an amount where, even when the wiper blades 70 are not contacting the front surfaces including the corner portions 21 of the inkjet recording heads 20 or the downstream side end portions of the nozzle surfaces 24, the ink N does not flow off into the interior of the inkjet recording apparatus 10.

In the present exemplary embodiments, the rotating member is configured by the conveyance drum 30 that conveys the recording paper P, but the exemplary embodiments can be also applied when the rotating member is configured by an intermediate transfer drum. The rotating member may also be an endless belt. Further, in the exemplary embodiments, the maintenance units 40 (the maintenance unit holder 42) were configured to move in the width direction of the recording paper P, but the inkjet recording apparatus 10 may also be configured such that the maintenance units 40 (the maintenance unit holder 42) are fixed and such that the inkjet recording heads 20 move in the width direction of the recording paper P.

Further, in the exemplary embodiments, the inkjet recording apparatus 10 has been described as the liquid droplet ejecting apparatus. However, the liquid droplet ejecting apparatus pertaining to the exemplary embodiments is not limited to the inkjet recording apparatus 10 and is also applicable to liquid droplet ejecting apparatus in general that perform recording using a liquid.

What is claimed is:

1. A liquid droplet ejecting apparatus comprising:

a liquid droplet ejecting head that includes nozzles that eject liquid droplets in accordance with image information, a nozzle surface thereof being inclined so as to correspond to a peripheral surface of a rotating member;

a wiping member that wipes and cleans the nozzle surface that has been moistened by liquid that has been exuded from the nozzles of the liquid droplet ejecting head, and whose wiping direction is a direction from a downstream side to an upstream side of a direction in which the liquid that has been exuded from the nozzles flows along the nozzle surface due to the force of gravity; and projecting portions in the wiping direction, being disposed at both end portions of the wiping member that do not contact the nozzles, wherein the wiping member contacts downstream side end portions of the nozzle surfaces when the liquid is exuded from the nozzles, and the projecting portions contact surfaces of the liquid droplet ejecting head that face in a wide direction of a recording medium.

2. The liquid droplet ejecting apparatus of claim 1, wherein the wiping member contacts, in a bent state, the downstream side of the liquid droplet ejecting head.

3. The liquid droplet ejecting apparatus of claim 2, wherein the wiping member bends as a result of the liquid droplet ejecting head moving to a position where the liquid droplet ejecting head is capable of contacting the wiping member and then the wiping member moving in the wiping direction.

4. The liquid droplet ejecting apparatus of claim 2, wherein the wiping member bends as a result of the wiping member moving a predetermined amount in the wiping direction and stopping, and then the liquid droplet ejecting head moving to a position where the liquid droplet ejecting head is capable of contacting the wiping member.

5. The liquid droplet ejecting apparatus of claim 1, wherein the nozzles are arrayed two-dimensionally, and the liquid is exuded from specific nozzles of the nozzles such that the nozzle surface is moistened across a width direction of a recording medium.

6. The liquid droplet ejecting apparatus of claim 5, wherein the specific nozzles are nozzles on the upstream side of the flow direction of the liquid.

7. The liquid droplet ejecting apparatus of claim 5, wherein the specific nozzles are nozzles on the downstream side of the flow direction of the liquid.

8. A liquid droplet ejecting apparatus comprising:

a liquid droplet ejecting head that includes nozzles that eject liquid droplets in accordance with image information, a nozzle surface thereof being inclined so as to correspond to a peripheral surface of a rotating member;

a wiping member that wipes and cleans the nozzle surface that has been moistened by liquid that has been exuded from the nozzles of the liquid droplet ejecting head, and whose wiping direction is a direction from a downstream side to an upstream side of a direction in which the liquid that has been exuded from the nozzles flows along the nozzle surface due to the force of gravity; and projecting portions that project in the wiping direction, being disposed at both end portions of the wiping member that do not contact the nozzles, wherein the wiping member contacts downstream side end portions of the nozzle surfaces when the liquid is exuded from the nozzles, and the projecting portions are formed at positions a predetermined amount away from a distal end surface of the wiping member, and contact both end portions of the nozzle surface where the nozzles are not formed.

* * * * *